United States Patent [19]

Pinson

[11] Patent Number: 4,907,009

[45] Date of Patent: Mar. 6, 1990

[54] ECCENTRICALLY DRIVEN SEEKER HEAD

[75] Inventor: George T. Pinson, Huntsville, Ala.

[73] Assignee: The Boeing Company, Seattle, Wash.

[21] Appl. No.: 94,326

[22] Filed: Sep. 8, 1987

Related U.S. Application Data

[63] Continuation-in-part of Ser. No. 696,484, Jan. 30, 1985, abandoned.

[51] Int. Cl.[4] ..... H01Q 3/00

[52] U.S. Cl. ..... 343/766; 343/757; 343/763

[58] Field of Search ..... 343/757, 763, 765, 766

[56] References Cited

U.S. PATENT DOCUMENTS 4,197,548 4/1980 Smith et al. ..... 343/757

4,714,930 12/1987 Winter et al. ..... 343/763

*Primary Examiner*—William L. Sikes

*Assistant Examiner*—Robert E. Wise

*Attorney, Agent, or Firm*—Finnegan, Henderson, Farabow, Garrett & Dunner

[57] ABSTRACT

A seeker head for a target pointer/tracker and the like, the head comprising a rigid mounting plate, an optical seeker for receiving a target signal, the seeker having a longitudinal axis, a joint proximate the longitudinal axis for securing the seeker to the mounting plate with freedom for reciprocal movement about at least two pivot axes perpendicular to the longitudinal axes, an eccentric driving element mounted on the mounting plate for selectively engaging the seeker to move the seeker about the pivot axes, and a controller for controlling operation of the eccentric drive element.

14 Claims, 6 Drawing Sheets

ECCENTRICALLY DRIVEN SEEKER HEAD

This application is a continuation-in-part of U.S. application Ser. No. 06/696,484, filed Jan. 30, 1985, now abandoned.

BACKGROUND OF THE INVENTION

1. Field of the Invention

This invention relates to an improved seeker head used with a target pointer/tracker and, more particularly, but not by way of limitation, to an eccentrically driven seeker head for high speed target tracking.

2. Description of Related Art

Heretofore there have been different types of seeker heads, such as AZ/EL and XY mounts. These types of mounts are well known in the art and are used typically on radar in deep space communication or surveillance devices. The AZ/EL mount has a blind spot in the direction perpendicular to the plane of one axis thereby restricting its use as a pointer/tracker for a target seeker. The XY mount avoids the AZ/EL blind spot which is normally directed towards the zenith of earth-mounted systems, by redesigning the axis such that the perpendicularity problem occurs near the earth's horizon. This results in typical keyhole areas for such mounts that prevent full hemispherical coverage.

Gimbal mounts are well known in the art and are designed for fast response. Gimbal locking problems, however, must be avoided. Additionally, a gimbal system is complex and usually too heavy.

A polar mount is a specialized version of an AZ/EL mount but is set to correspond to a latitude in which the device is to be used. This type of mount is not applicable to an application requiring random search orientation. Spinning mass type heads are fast enough to provide tracking information. These heads, however, are complex and are very limited as to field of regard, commonly under +/−8° and are not suitable for use with a large mass.

A pointer/tracker designed by Reinhold, U.S. Pat. No. 4,538,880, provides a high rate of secondary motion and meets the needs of seekers with small heads. This design, however, uses a push/pull set of linear actuators to provide scanning and tracking capabilities. The system is not capable of moving a large mass.

Various mounts designed by the subject inventor, i.e., U.S. Pat. Nos. 4,158,845 and 4,521,782, are well adapted for a seeker requiring rapid head movement through large angles in excess of +/−20°. For small angular motion, such as 1−2° required for target tracking response time, a high speed tracker may be required to provide the secondary motion necessary to accurately measure rates and angles. The subject invention described herein provides the solution to the above-mentioned problems.

SUMMARY OF THE INVENTION

The objects and advantages of the invention may be realized and obtained by means of the instrumentalities and combinations particularly pointed out in the appended claims.

In accordance with the invention, as embodied and broadly described herein, a seeker head for a target pointer/tracker and the like comprises a rigid mounting plate, seeker means for receiving a target signal, the seeker means having a longitudinal axis, means proximate the longitudinal axis for securing the seeker means to the plate with freedom for reciprocal movement about at least two pivot axes perpendicular to the longitudinal axis, cam means rotatably mounted on the plate for selectively engaging the seeker means to move the seeker means about the pivot axes, and means for controlling the cam means to selectively generate desired scanning patterns of the seeker means.

Preferably the securing means includes cooperating annular members extending from the plate and the seeker means which are disposed for engagement at their distal ends. The preferred engaging mechanism is an annular ball and socket joint interconnecting the distal ends of the members. Alternatively, an annular 0-ring joint may be used.

In the preferred embodiment, the cam means comprises two cam assemblies each including a cam motor disposed on the plate and a cam element connected to the cam motor for selective rotation, one cam assembly being disposed to engage the seeker means on each pivot axis and to move the seeker means about the other pivot axis.

The seeker head may also include means for modifying the amplitude of the scanning patterns which comprises means for radially moving the cam assemblies toward and away from the longitudinal axis.

As an alternative embodiment to the cam assemblies, the cam means may comprise two crank assemblies each including a motor fixed to the plate and an eccentric crank arm having one end connected to the motor for selective rotation and the other end connected to the seeker means

BRIEF DESCRIPTION OF THE DRAWINGS

The accompanying drawings, which are incorporated in and constitute a part of the specification, illustrate one embodiment of the invention, and together with the description, serve to explain the principles of the invention.

DETAILED DESCRIPTION OF THE PREFERRED EMBODIMENTS

Reference will now be made in detail to the present preferred embodiments of the invention, examples of which are illustrated in the accompanying drawings.

The seeker head for a target pointer/tracker and the like comprises a rigid mounting plate, seeker means for receiving a target signal, the seeker means having a longitudinal axis, and means proximate the longitudinal axis for securing the seeker means to the plate with freedom for reciprocal movement about at least two pivot axes perpendicular to the longitudinal axis.

Figure 1:
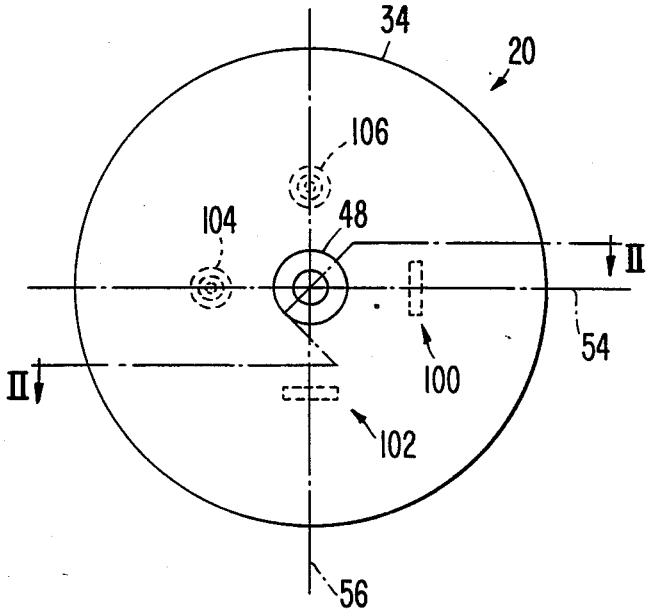
FIG. 1 is a diagrammatic end view of the seeker head of the invention.
Figure 2:
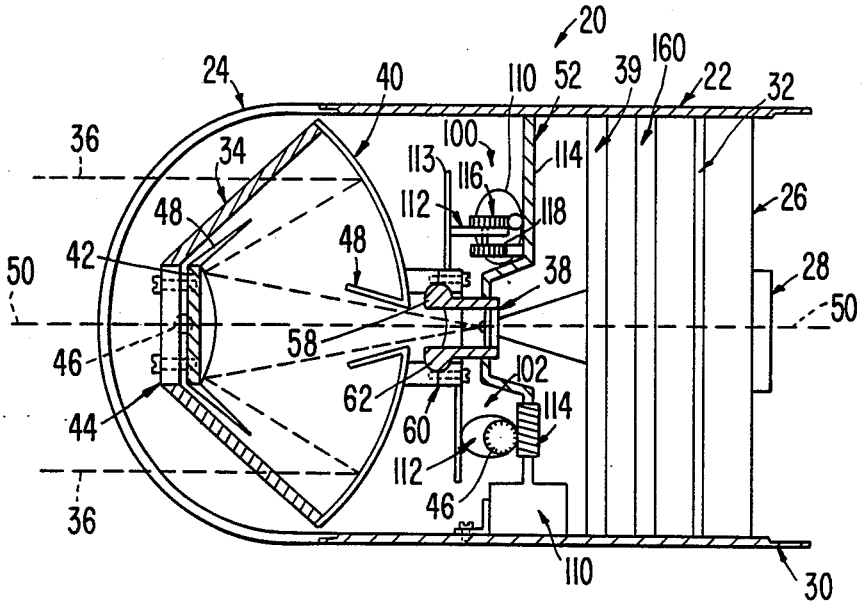
FIG. 2 is a cross-sectional view of an embodiment of the invention generally taken along lines II—II of FIG. 1.

Preferably, as depicted in FIGS. 1 and 2, seeker head 20 includes an outer shell or air frame 22 providing the primary support structure. A wind screen or dome 24 provides a weather tight seal for the forward section of the seeker head. A rear interface structure 26 completes the seeker head structure. Electrical interfaces between the user vehicle, which may be a missile, and the seeker head are provided through appropriate electrical connectors 28. A mechanical structural interface 30 provides means to connect the seeker head to the user vehicle. Electrical power for the seeker head is provided by a power board 32.

While seeker head 20 depicted in FIG. 2 is for infrared use, the head may be adapted to any type of application requiring the movement of relatively massive structures at a high response rate. In the embodiment shown, the seeker means comprises an optical platform 34 for receiving infrared energy 36 and for focusing energy 36 on a detector package 38. Detector package 38 consists of the necessary filters, detector elements and coolers, and is wired to preamp board 39. Optical platform 34 includes primary reflector 40 and secondary reflector 42, the latter attached to an adjustable mount 44. Secondary reflector 42 is provided with two degrees of freedom by bearing joint 46 for optical alignment. Baffling 48 completes the seeker means. The seeker means or optical platform 34 symmetrically extends around longitudinal axis 50.

The seeker means, or optical platform 34, is secured for operation in shell 22 to rigid mounting plate 52 through securing means proximate longitudinal axis 50 which provides freedom for reciprocal movement about at least two pivot axes 54, 56 (FIG. 1) perpendicular to longitudinal axis 50. In the preferred embodiment, the securing means is an annular ball and socket joint 58 which provides a low friction universal joint between the movable optical platform 34 and fixed mounting plate 52. As may be seen in FIGS. 2-5, ball and socket joint 58 includes annular member 60 fixed to and projecting from primary reflector 40 of optical platform 34 and annular member 62 fixed to and projecting from mounting plate 52. Both annular members 60, 62 are disposed coaxially with each other and with longitudinal axis 50. The distal ends of annular members 60, 62 are disposed in engaging relationship.

Figure 3:
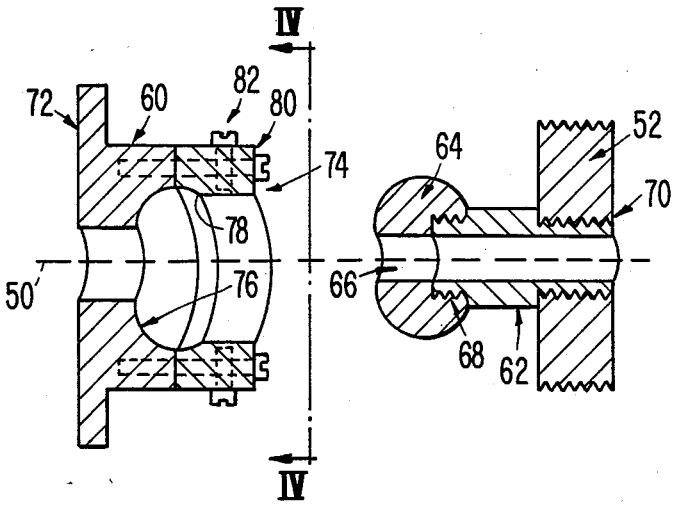
FIG. 3 is an enlarged, cross-sectional, exploded view of the ball-socket joint of the embodiment of FIG. 1.
Figure 4:
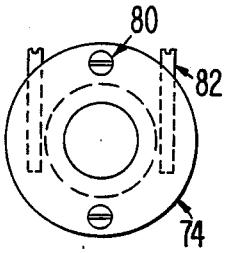
FIG. 4 is an end view of a component of the ball-socket joint taken along lines IV—IV of FIG. 3.

As best seen in FIG. 3, ball 64 of ball and socket joint 58 is formed on the distal end of annular member 62 which is rigidly fixed to mounting plate 52. Preferably, ball 64 is machined or cast from aluminum, although any suitable metal or nonmetal is acceptable provided that the strength, thermal properties and wear properties are met. Ball 64 is precision ground and highly polished. Ball 64 can be made as a precision bearing and drilled to provide bore 66 which is tapped at one end to threadably receive the distal end 68 of projecting member 62. Projecting member 62 may be threadably secured at the other end in tapped hole 70 in mounting plate 52. Alternatively, a single, thick-walled tube may be precision machined to produce ball 64, projecting member 62 and a threaded end for tapped hole 70. Preferably, the surface of ball 64 is coated with materials such as polytetrafluoraethylene impregnated with aluminum oxide or lubricated to prolong wear and reduce friction.

Member 60 fixed to and projecting from primary reflector 40 is preferably formed of two annular components 72, 74, component 72 being fixed to primary reflector 40 and component 74 being detachably secured to component 72. One half of a precision socket 76 is machined into element 72 and a complementary portion 78 of the precision socket is machined into element 74. The surface of the socket may coated or lubricated in the same manner as the ball. To join the ball and socket assembly, element 74 is removed, ball 64 is disposed in socket portion 76 and element 74 is replaced and secured in position by means of screws 80. It should be noted that portion 78 of the socket is not a full ¼ negative hemisphere. A compromise between the percent of negative hemisphere which is needed to capture ball 64 and the angular rotation available for the seeker means must be made.

Figure 5A:
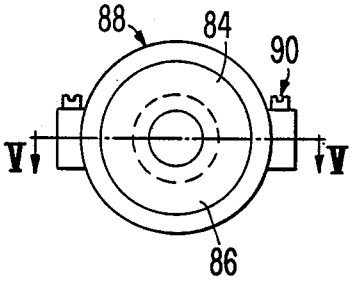
FIG. 5A is an end view of an alternative embodiment of the component of FIG. 4
Figure 5B:
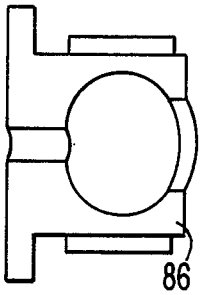
FIG. 5B is a cross-sectional view of the component of FIG. 5A taken along lines V—V.
Figure 6A:
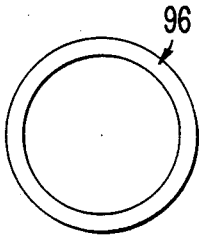
FIG. 6A is a plan view of an 0-ring.
Figure 6B:
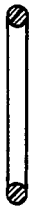
FIG. 6B is a cross-sectional view of the 0-ring of FIG. 6A.

In one embodiment, element 72 of projecting member 60 is formed in one piece and element 74 is split in two pieces to be fit over ball 64. The two pieces of element 74 are attached to each other by screws 82 and to element 72 by screws 80. In a preferred embodiment, as depicted in FIGS. 5A and 5B, projecting member 60 is formed in two halves 84, 86, one of which is secured to primary reflector 40 and the other of which is removably attached by band 88 and fastners 90.

Figure 7:
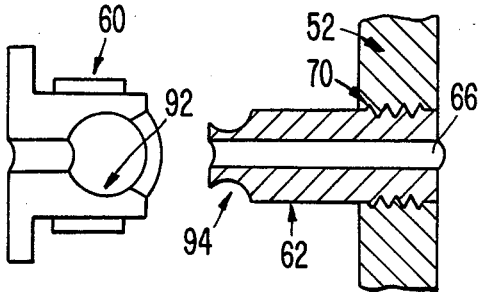
FIG. 7 is an exploded cross-sectional view of the components of an alternative embodiment of the securing means of the invention.

In an alternative embodiment, the securing means may comprise an 0-ring joint which may provide low cost manufacturing advantages over the use of a ball joint. As seen in FIG. 7, the distal ends of projecting members 60, 62 are machined with partial grooves 92, 94, respectively, which, when assembled, securely receive an 0-ring 96. Assembly is effected by use of the split projecting member 60 as discussed with respect to FIGS. 5A and 5B above. The alternative structure of FIGS. 3 and 4 also may be used.

The 0-ring joint provides two means of motion between the seeker means and the mounting plate. The first permits partial grooves 91, 94 to rotate about 0-ring 96 in a frictional bearing motion. The second method entails placing 0-ring 96 between complementary grooves 92, 94 under compression In the latter, 0-ring 96 acts as a compliant bearing where the material of the 0-ring provides both resistance and a restoring force to the joint. Preferably 0-ring 96 is formed of a suitable material such as neoprene.

Other securing means may be used, provided freedom for reciprocal movement about at least two pivot axes is permitted. Ball and socket joints as disclosed in U.S. Pat. Nos. 4,158,845, 4,246,661, 4,266,173, 4,364,272, 4,521,782, and 4,577,825 may also function as a securing means in the invention.

In accordance with the invention, the seeker head comprises cam means rotatably mounted on the mounting plate for selectively engaging the seeker means to move the seeker means about the pivot axes, and means for controlling the cam means to selectively generate desired scanning patterns of the seeker means.

In the preferred embodiment, as depicted in FIGS. 1 and 2, the cam means comprises two cam assemblies 100,102. One cam assembly 100 is disposed on pivot axis 54 to pivot the seeker means about pivot axis 56, and the other cam assembly 102 is disposed on pivot axis 56 to pivot the seeker means about pivot axis 54. Preferably, means disposed between the seeker means and mounting plate 52 are provided to generate an opposing moving force acting on seeker means to move the seeker means in a direction about the pivot axis opposite that generated by the cam assembly. As seen in FIG. 1, springs 104, 106 are disposed in opposed relation to cam assemblies 100, 102, respectively, and serve to bias optical platform 34 about the respective pivot axis 56, 54. Alternatively, additional cam assemblies could be substituted for springs 104, 106. Only two cam assemblies, oriented at 90° to each other, are required to drive optical platform 34 with two degrees of freedom. Additional cam assemblies disposed in opposition with the two may be used for redundancy, to reduce power requirements of each motor, or to drive heavier loads.

Each cam assembly preferably includes a cam motor 110 disposed on mounting plate 52 and a cam element 112 connected to cam motor 110 for selective rotation In the embodiment depicted in FIG. 2, cam assemblies 100, 102 are disposed to engage cam bearing surface 113 which is fixed to projecting member 60. It is evident that the structure could be modified for the cam assemblies to bear against primary reflector 40 to achieve the same functional purpose.

In cam assemblies 100, 102, motor 110 turns worm gear 114 which is meshed with drive gear 116. Drive gear 116 is attached to and drives cam 112. Cam 112 is attached through bearing 118 to mounting plate 52. Cam 112 can be elliptically shaped, a round disk with an eccentric axis or any shaped cam which, when interacting with cam bearing surface 113 or primary reflector 40 moves the entire optical platform 34 in pitch and yaw directions.

Figure 8:
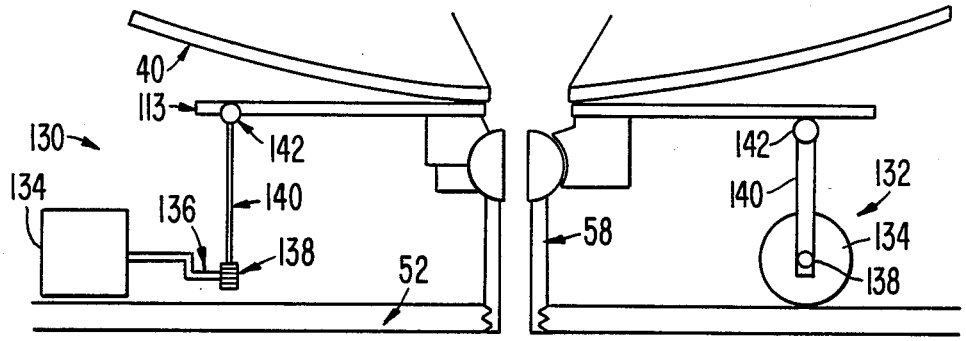
FIG. 8 is a plan view of an alternative embodiment of the cam means of the invention.

In an alternative embodiment, the cam means may comprise two crank assemblies 130,132 as depicted in FIG. 8. The crank assemblies are disposed 90° with respect to each other in the same manner as the cam assemblies. Each crank assembly includes a motor 134 and an eccentric crank arm 136 having one end connected to the motor for selective rotation and the other end connected to the seeker means. In the embodiment depicted in FIG. 8, crank arm 136 is secured to cam bearing surface 113 via bearing 138, rod 140 and ball joint 142. Selective activation of motors 134 imparts movement to primary reflector 40 about securing means 58 in two axes.

Figure 9:
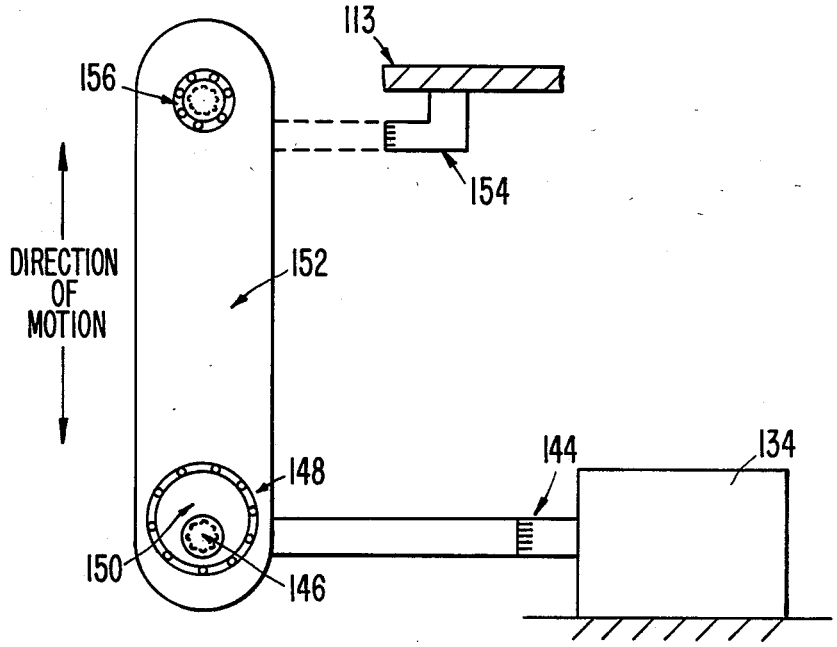
FIG. 9 is a diagrammatic plan view of one embodiment of the components of the cam means of FIG. 8.

An alternative embodiment of a crank assembly is depicted in FIG. 9 wherein motor 134 includes drive shaft 144 which is connected to fitting 146 eccentrically on bearing 148 to produce a cam 150. Rotation of motor 134 results in reciprocating motion of shaft 152. The other end of shaft 152 is affixed to cam bearing surface 113 or directly to primary reflector 40 by means of connecting rod 154 which is fixed to shaft 152 through bearing 156.

Figure 11A:
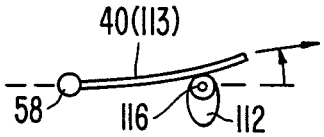
FIGURES 11A and 11B are diagrammatic illustrations of the function of the cam means of the invention.
Figure 11B:
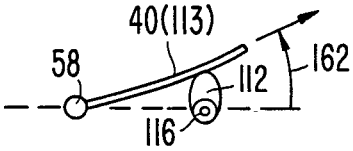

Operative control of the scanning of optical platform 34 is achieved by connecting cam motors 110 (FIG. 2) or crank motors 134 (FIG. 8) to a pulse width modulation controller located, for example, in a control board 160 as depicted in FIG. 2. The controller effects rotation of the motors and therefore the cams or cranks to generate a harmonic motion in the optical platform with deflection to some maximum angle 162 as seen in FIG. 11B. Further rotation of cam 112 causes optical platform 34 to return to the null position as seen in FIG. 11A due to the restoring force generated by springs 104, 106 or secondary cam assemblies used in lieu of the springs.

Figure 12:
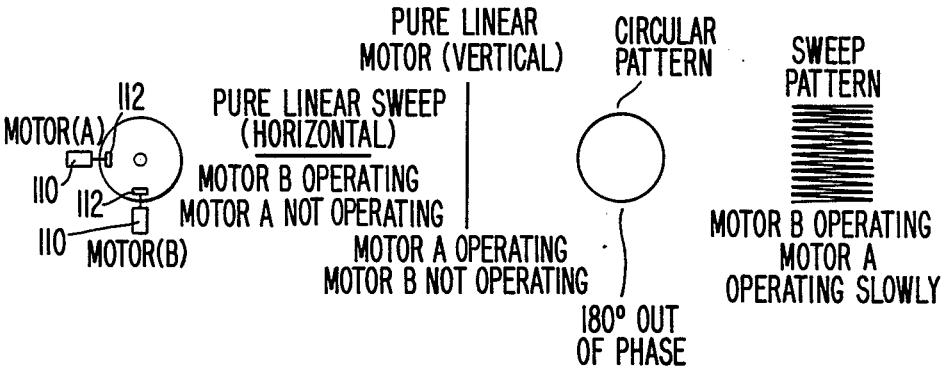
FIGS. 12 and 13 illustrate scan patterns available from use of the invention.
Figure 13:
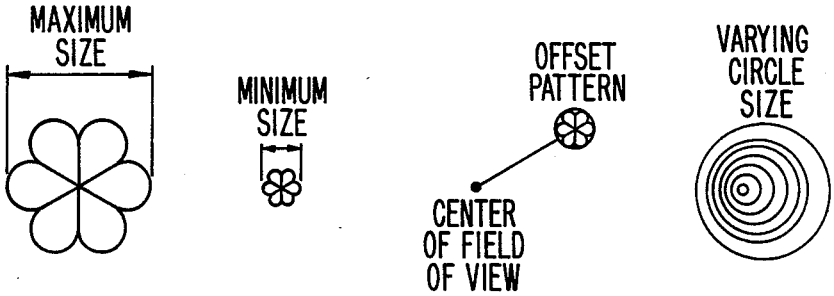

Selective control of the two motors 110, motor A and motor B as seen in FIG. 12, provides means for generating a variety of different scanning patterns. As shown in FIG. 12, if only one motor is operated, the optical platform will scan in a linear sweep, either horizontally or vertically. If both motors are operated 180° out of phase at the same speed, a circular pattern is generated. Thus depending on the phase relationship and relative speed between the two motors, any number of scanning patterns can be generated. Indeed, scanning patterns as depicted in FIG. 13 may be generated where one or more of the motors is operated over only a portion of its operating range. This operation, also controlled by the controlling means, requires periodic reversal of direction of rotation of the cam or crank arm.

Figure 10:
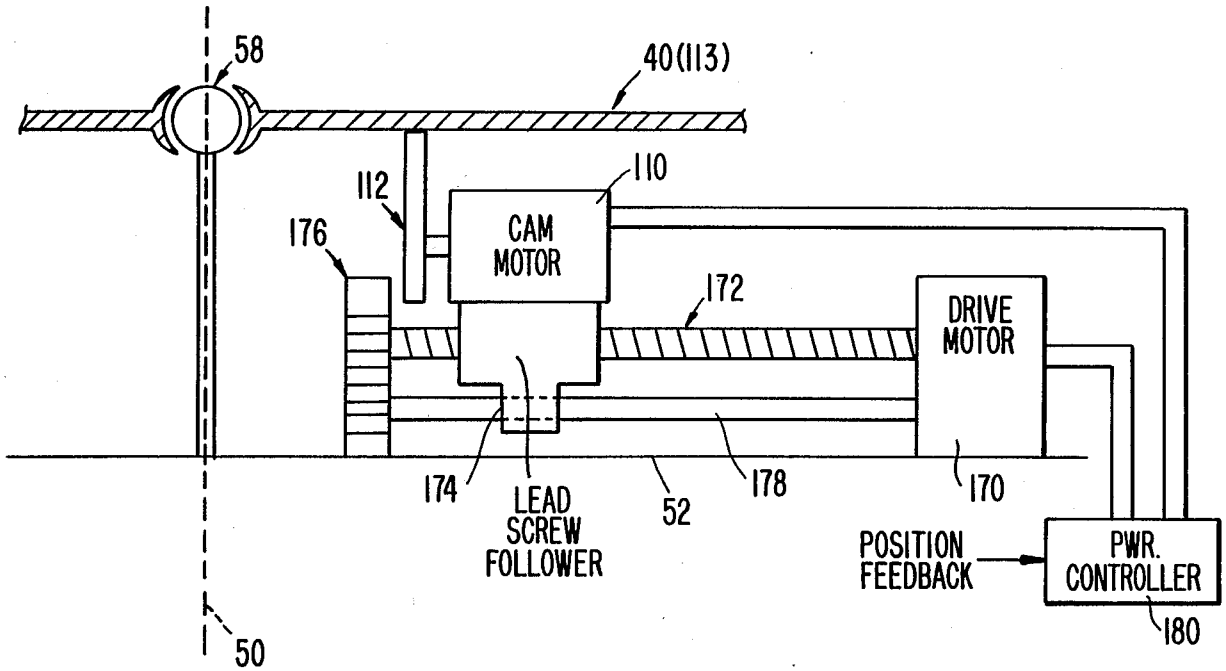
FIG. 10 is a diagrammatic cross-sectional view of an alternative embodiment of the cam means of the invention.

Preferably, the invention also includes means for modifying the amplitude of the scanning patterns which would generate different size scanning patterns. Such a modifying means, as depicted in FIG. 10, includes means for radially moving the cam assemblies toward and away from the longitudinal axis. The radially moving means comprises a platform disposed for linear radial movement and a motor disposed on the mounting plate for selectively moving the platform, the cam assembly being supported by the platform. As seen in FIG. 10, drive motor 170 is mounted on mounting plate 52 for selective rotation of worm gear 172. Operatively mounted on worm gear 172 is lead screw follower 174 which serves as a platform for carrying cam motor 110 and cam 112. The other end of worm gear 172 is mounted in bearing 176 which also supports guide rod 178 along which follower 174 is slidably movable. The controller 180 controls operation of drive motor 170 and cam motor 110. Worm gear 172 and follower 174 may be of the type available from Kerk Motion Products of Hollis, N.H. By the arrangement in FIG. 10, the radial position of the cam assembly can be varied and this variation in conjunction with variations in the speed, phase and direction of rotation of cam 112 will generate scanning patterns of the type depicted in FIG. 13.

The invention also contemplates feedback to the controller means which may be obtained by a potentiometer, a reflective quadrant detector or any other position sensing device attached to a cam motor or drive motor. Alternatively, a reflector position indicator using a focused light emitting diode or light source and quadrant detectors could be used to directly determine the position of the primary reflector 40 or cam bearing surface 113 to provide feedback to the controller.

It will be apparent to those skilled in the art that various modifications and variations could be made in the seeker head of the invention without departing from the scope or spirit of the invention.

What is claimed is:

1. A seeker head for a target pointer/tracker and the like, the head comprising:

a rigid mounting plate;

seeker means for receiving a target signal, said seeker means having a longitudinal axis;

means proximate said longitudinal axis for securing said seeker means to said plate with freedom for reciprocal movement about at least two pivot axes perpendicular to said longitudinal axis;

cam means for mounted eccentric rotation on said plate for selectively engaging said seeker means to move said seeker means about said pivot axes; and means for controlling operation of said cam means to selectively generate desired scanning patterns of said seeker means.

2. The seeker head of claim 1 wherein said securing means comprises an annular member fixed to and projecting from each of said plate and said seeker means, said members being coaxial with said longitudinal axis and the distal ends of said members being disposed in engaging relationship.

3. The seeker head of claim 2 wherein the distal ends of said members are operatively joined by an annular ball and socket joint, the ball being integral with the distal end of one said annular members and the annular socket being cooperatively disposed in the distal end of the other annular member.

4. The seeker head of claim 2 wherein the distal ends of said members are operatively joined by an annular 0-ring joint, the 0-ring being secured between complementary annular grooves in the distal ends of said annular members.

5. The seeker head of claim 1 wherein said cam means comprises two cam assemblies each including a cam motor disposed on said plate and a cam element connected to said cam motor for selective rotation, one said cam assembly being disposed to engage said seeker means on each said pivot axis and to move said seeker means about the other said pivot axis.

6. The seeker head of claim 5 also including means disposed between said seeker means and said plate in opposed relation to each said cam assembly for moving said seeker means about said other pivot axis in a direction opposite to that generated by said cam assembly.

7. The seeker head of claim 6 wherein said moving means comprises a spring.

8. The seeker head of claim 6 wherein said moving means comprises a secondary cam assembly disposed in opposed relation to each said cam assembly.

9. The seeker head of claim 8 wherein operation of said secondary cam assembly is controlled by said controlling means.

10. The seeker head of claim 5 also including means for modifying the amplitude of said scanning patterns.

11. The seeker head of claim 10 wherein said modifying means includes means for radially moving said cam assemblies toward and away from said longitudinal axis.

12. The seeker head of claim 11 wherein said radially moving means comprises a platform disposed for linear radial movement and a motor disposed on said plate for selectively moving said platform, said cam motor and cam element being supported by said platform.

13. The seeker head of claim 1 wherein said cam means comprises two crank assemblies each including a motor fixed to said plate and an eccentric crank arm having one end connected to the motor for selective rotation and the other end connected to said seeker means, one said crank assembly being disposed on each said pivot axis to move said seeker means about the other said pivot axis.

14. A seeker head for a target pointer/tracker and the like, the head comprising:

a rigid mounting plate;

a target signal receiving seeker having a longitudinal axis and being pivotally fixed to said plate for reciprocal movement about at least two pivot axes orthogonal to said longitudinal axes;

two eccentrically-mounted drivers each driver being fixed to said plate for selective rotation about an axis parallel to a respective one of said pivot axes and engaging said seeker to selectively move it about said other pivot axis; and means for controlling operation of said drivers to selectively generate desired scanning patterns of said seeker.

* * * * *